United States Patent [19]

Valinski, Sr.

[11] 4,397,119

[45] Aug. 9, 1983

[54] ADJUSTABLE CRANKPIN LOCATORS FOR A CRANKSHAFT GRINDING MACHINE

[75] Inventor: Peter J. Valinski, Sr., Worcester, Mass.

[73] Assignee: The Warner & Swasey Company, Cleveland, Ohio

[21] Appl. No.: 238,393

[22] Filed: Feb. 24, 1981

[51] Int. Cl.[3] ..... B24B 49/00

[52] U.S. Cl. ..... 51/165 R; 33/180 B; 51/237 CS; 51/277

[58] Field of Search ..... 51/237 CS, 237 R, 105 SP, 51/165 R, 2 Z, 277; 33/180 B, 181 AT; 269/242, 902

[56] References Cited

U.S. PATENT DOCUMENTS

| | | | |
|---|---|---|---|
| 509,810 | 11/1893 | Hyre | 269/242 |
| 1,461,083 | 7/1923 | Damerell | 33/180 B |
| 2,183,490 | 12/1939 | Flygare | 51/2 Z |
| 2,329,382 | 9/1943 | Blazek | 51/165 R |
| 3,147,573 | 9/1964 | Flohr | 51/105 SP |
| 3,769,761 | 11/1973 | Ohsima | 51/237 CS |
| 3,926,422 | 12/1975 | Wilson | 269/71 |

*Primary Examiner*—Harold D. Whitehead
*Attorney, Agent, or Firm*—Howard G. Massung

[57] ABSTRACT

A pair of adjustable crankpin locators (40,100) for use on a crankshaft grinding machine (20) is disclosed. The adjustable crankpin locators (40,100) permit a size range of crankshafts (78) to properly be located in the grinding machine (20). One locator is an adjustable vee block locator (40) wherein the sides of the vee block are relatively positionable to accommodate a range of crankshafts (78) having different throws and different crankpin diameters. A supporting assembly (42) is provided on the crankshaft grinding machine (20) for supporting the adjustable vee block locator (40) in position to properly locate one crankpin (80) on the crankshaft (78) to be ground. An adjustable stud crankpin locator (100) is also provided for locating the crankshaft (78) in proper position, after the first crankpin (80) is ground, for grinding a 180° displaced second crankpin (82). The adjustable stud crankpin locator (100) can also accommodate a range of crankshaft sizes. Interlocks are provided to assure locators (40,100) are in a remote parking bracket before grinding machine (20) can operate.

3 Claims, 11 Drawing Figures

FIG. 9
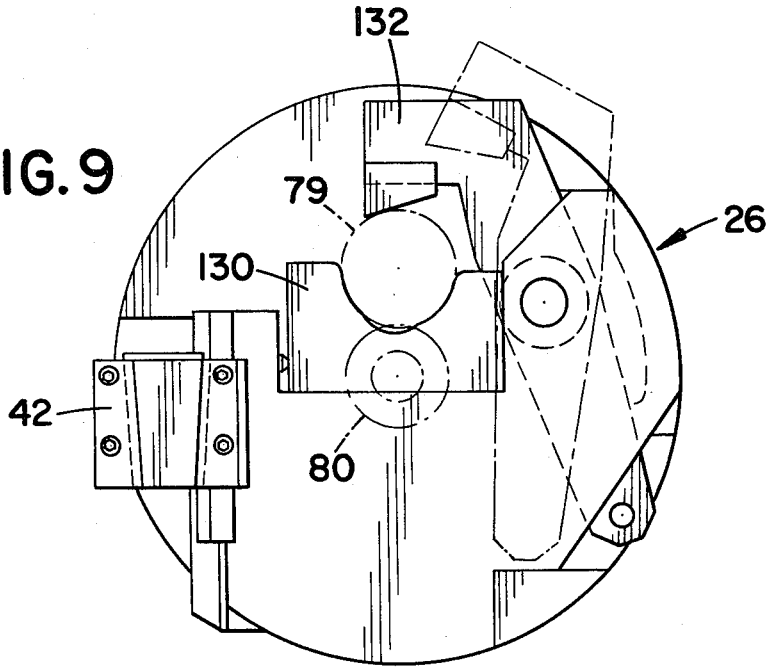
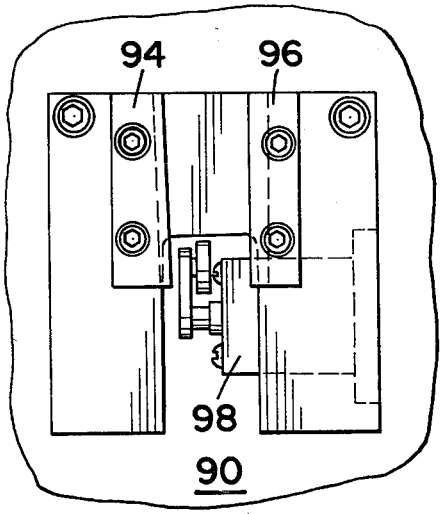
FIG. 11
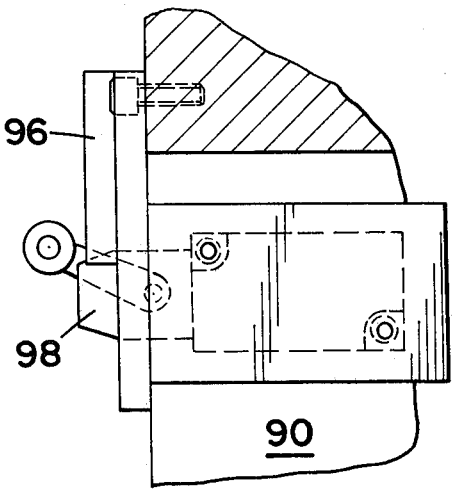
FIG. 10

ADJUSTABLE CRANKPIN LOCATORS FOR A CRANKSHAFT GRINDING MACHINE

BACKGROUND OF THE INVENTION

Technical Field

This invention relates to grinding machines and more particluarly to adjustable crankpin locating devices for use on a crankshaft grinding machine.

Background Art

It is known in the prior art to use a fixed vee block assembly for locating crankpins of a crankshaft before grinding.

DISCLOSURE OF THE INVENTION

The present invention is embodied in a crankshaft grinding machine having a pair of adjustable locators for locating the crankpins before grinding. One locator is an adjustable vee block locator wherein the vee block sides are relatively movable to accomodate a range of crankshafts having different throws and different crankpin diameters. A support assembly is provided on the crank shaft grinding machine for holding the adjustable vee block locator in a proper position for aligning the crankpin of the crankshaft before it is ground. The sides of the adjustable vee block locator assembly are connected by a threaded shaft having a left-handed thread on one end and a right-hand thread on the other. A knurled adjusting wheel is provided on the elongated shaft for rotating the shaft to move the vee block sides to the desired position. A locking device is provided for engaging the knurled adjusting wheel and holding it in the desire position. The locking device can be an adjusting screw which engages the adjusting wheel. After the crankpin is located the ends of thc crankshaft are gripped by the grinding machine to rotate the crankpin about its axis, which does not correspond with the axis defined by the ends of the crankshaft. The adjustable vee block locator is moved to a storage or parked position remote from the crankshaft during a grinding operation.

An adjustable stud locator which is used in conjunction with the adjustable vee block locator is also provided. The adjustable stud locator is used to locate the ground crankpin at a position 180°, or other desired angle, rotated with respect to its position when being ground. Rotating the crankshaft 180° locates the second crankpin in position to rotate about its longitudinal axis. The adjustable stud locator has a plurality of threaded studs which are adjustable and offset to locate a range of different size and throw crankshafts. The adjustable stud locator is manually adjusted by screwing the studs in or out to obtain 180° location of the crankshaft and to maintain dimensional tolerances from the first crankpin ground. A locknut is provided to lockeach adjustable stud in place. The adjustable stud locator when used to locate the position of the crankshaft is supported by the same support assembly which is used for supporting the adjustable vee block locator during initial crankpin positioning. After the crankshaft is located and before grinding the adjustable stud locator must be removed to a storage or parked position.

A pair of storage or parking brackets are provided for holding the adjustable vee block locator and the adjustable stud locator during grinding. The parking brackets are provided with electrical interlocks which inhibit operation of the grinding machine until both locators are in the parked location.

BRIEF DESCRIPTION OF THE DRAWINGS

For a better understanding of the invention, reference may be had to the preferred embodiment exemplary of the invention shown in the accompanying drawings in which:

FIG. 9 is a view of the workholder which supports one end of the crankshaft for rotating about one of its crankpins;

FIG. 10 is a side view of a parking bracket where one of the adjustable locators is stored; and, FIG. 11 is a front view of the parking bracket shown in FIG. 10.

BEST MODE FOR CARRYING OUT THE INVENTION

Figure 1:
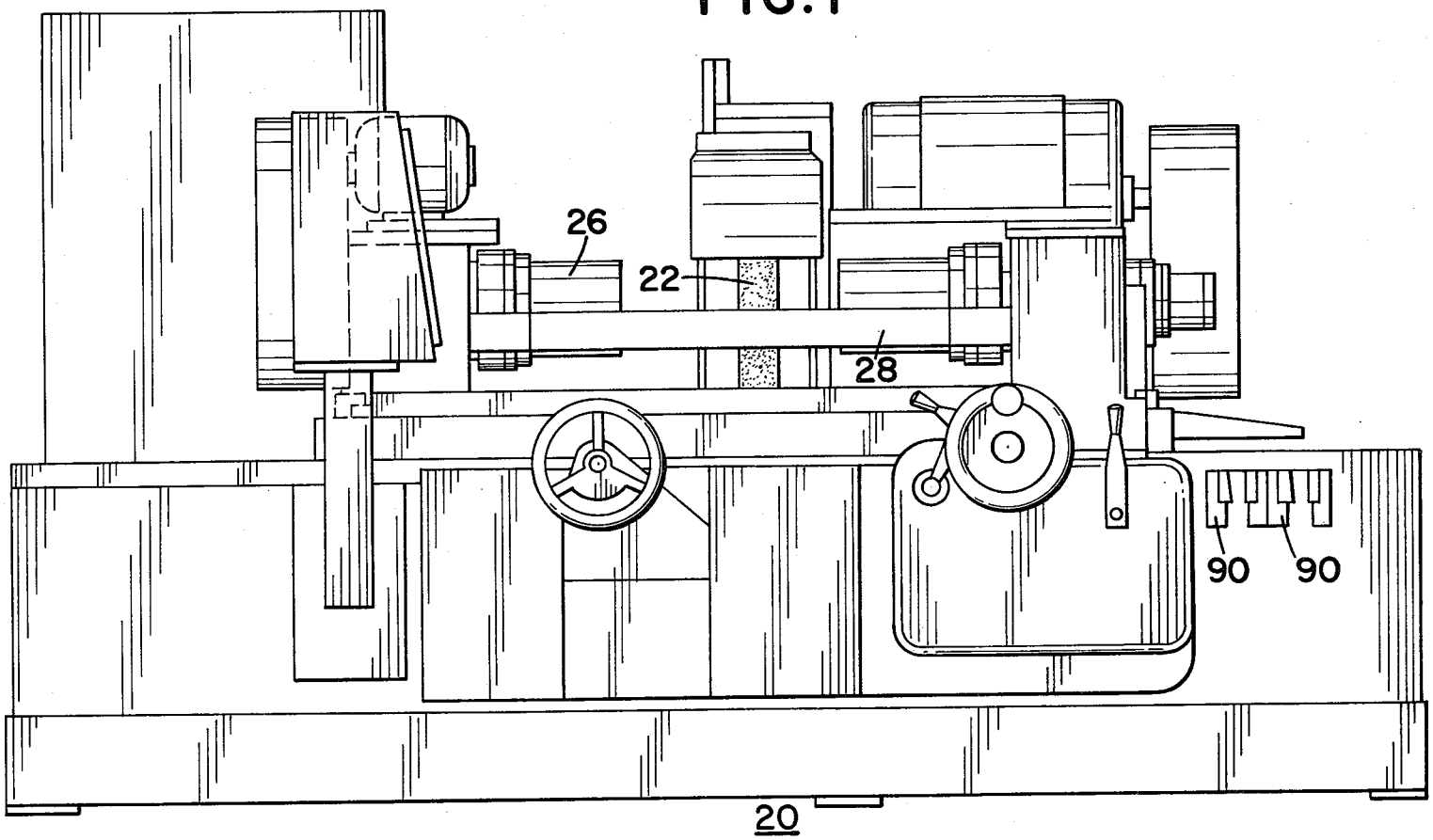
FIG. 1 is a front view of a crankshaft grinding machine on which locators according to the present invention are utilized.
Figure 2:
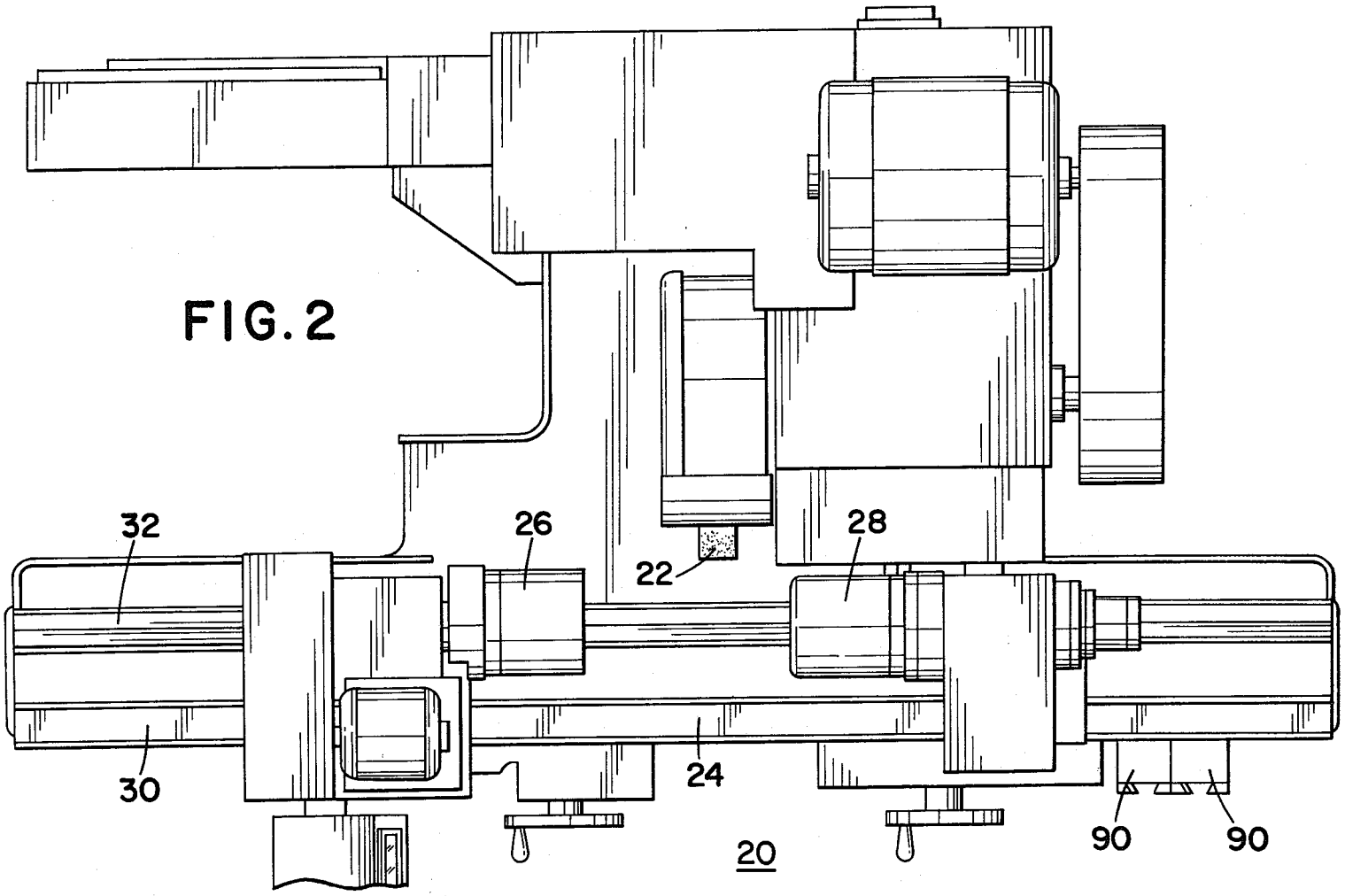
FIG. 2 is a plan view of the grinding machine of FIG. 1.

Referring now to the drawings, and FIGS. 1 and 2 in particular, there is shown a crankshaft grinding machine 20 on which adjustable locators according to the present invention are utilized. Grinding machine 20 has driven grinding wheel 22 which is positionable along fixed ways with respect to the grinding machine front. A positionable table 24 has workheads 26 and 28 supported thereon. Workheads 26, 28 support crandshafts for rotation about a selected crankpin. Workhead 26 is drived to rotate the crankshaft at a selected speed. Table 24 is positioned on a pair of ways 30 and 32 which extend along the front of grinding machine 20.

Table 24 is positioned to bring a crankshaft, supported by workheads 26, 28 to a location where driven grinding wheel 22 can move forward and engage a selected crankpin. After the first crankpin is ground, the angular orientation of the crankshaft is changed and table 24 is shifted to bring a second crankpin in position to be ground.

Figure 3:
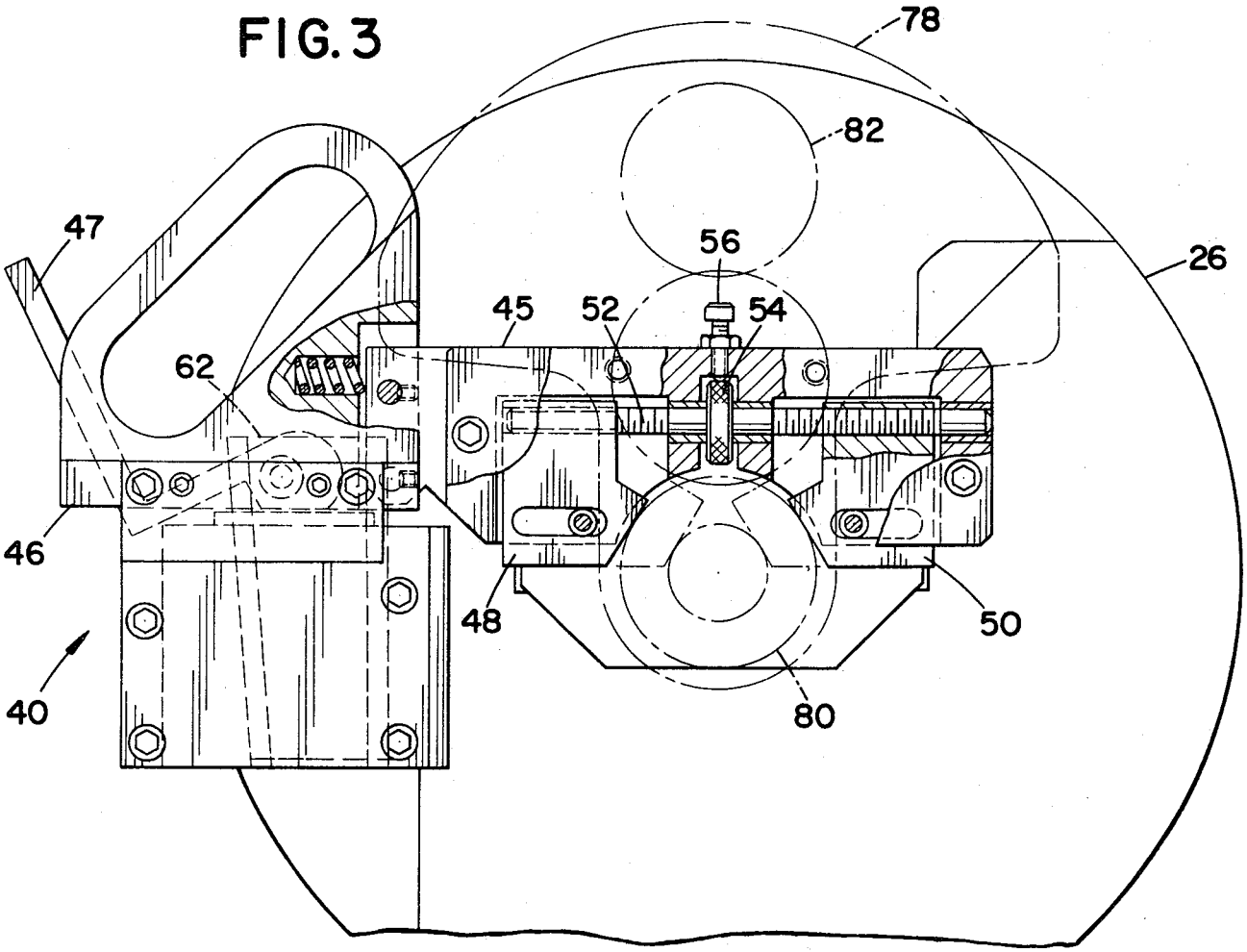
FIG. 3 is a side view, with portions removed for clarity, of an adjustable vee block locator according to the present invention.
Figure 4:
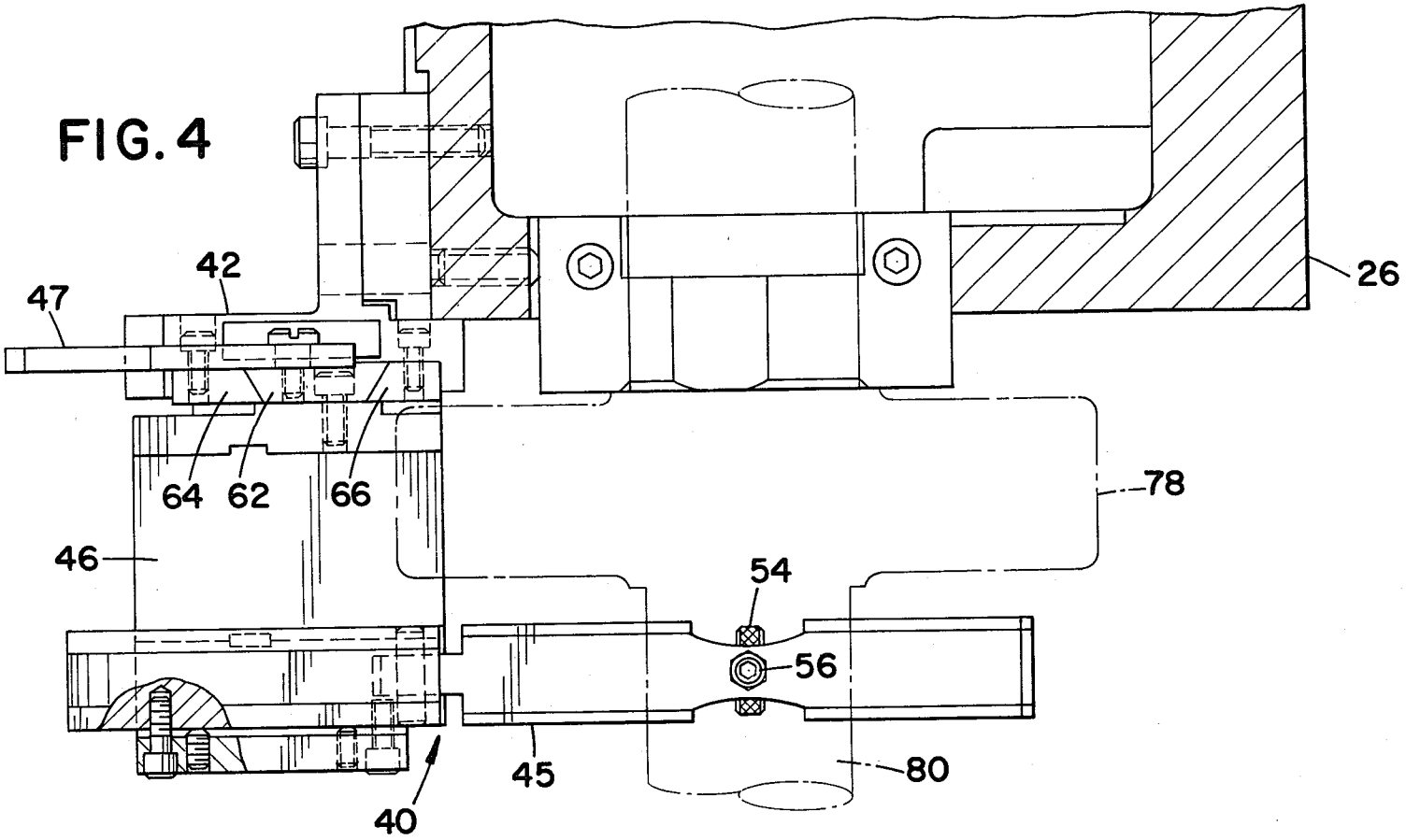
FIG. 4 is a top view of the locator shown in FIG. 3.
Figure 5:
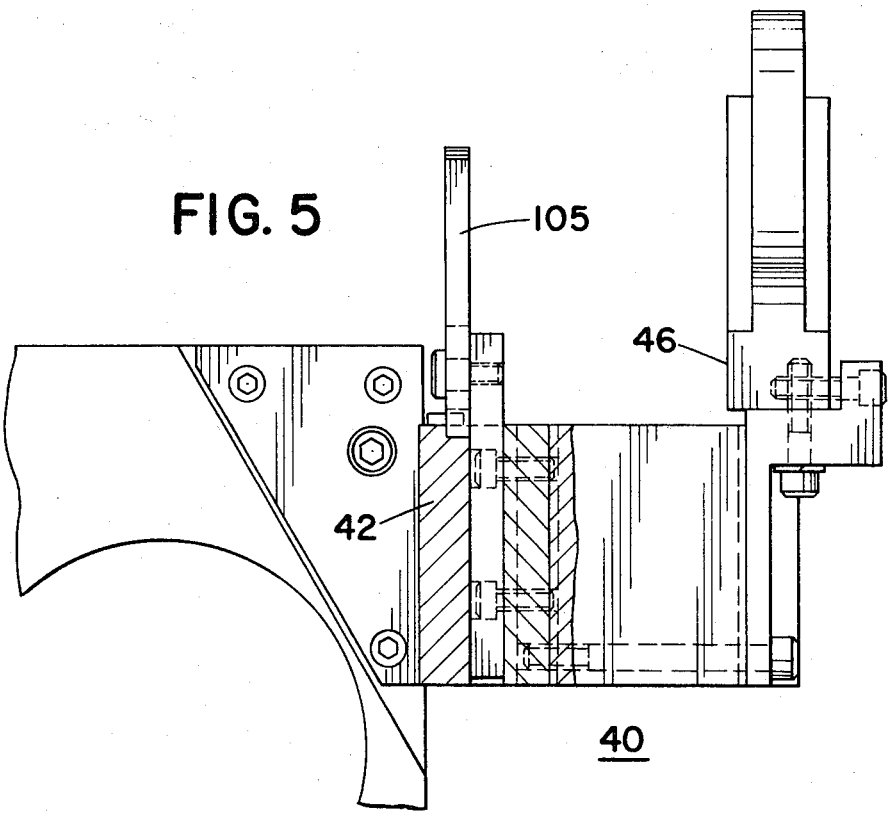
FIG. 5 is a left end view of the locator shown in FIG. 4.
Figure 7:
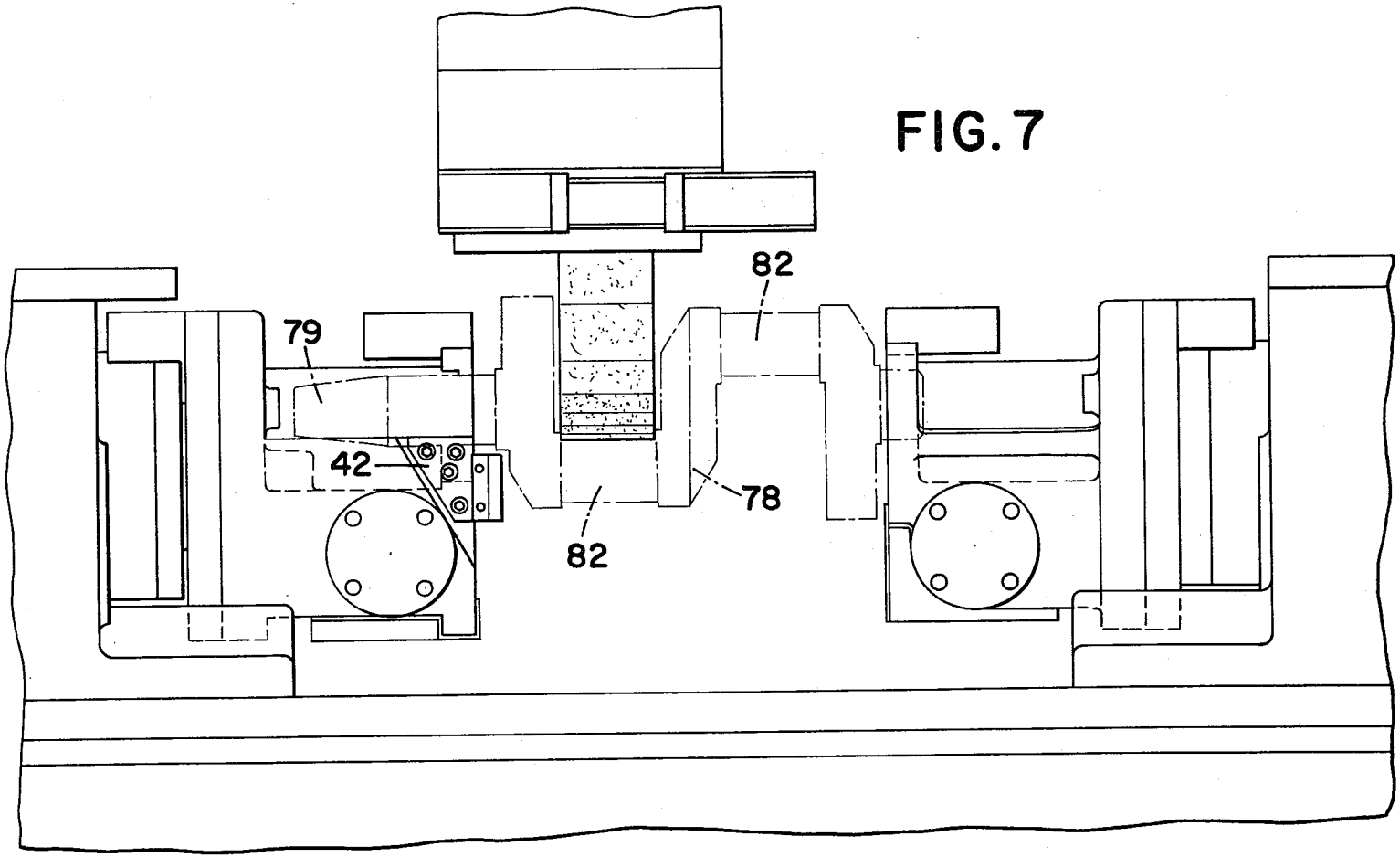
FIG. 7 is an enlarged view of a portion of the grinding machine of FIG. 1 showing a crankshaft in place for grinding.
Figure 8:
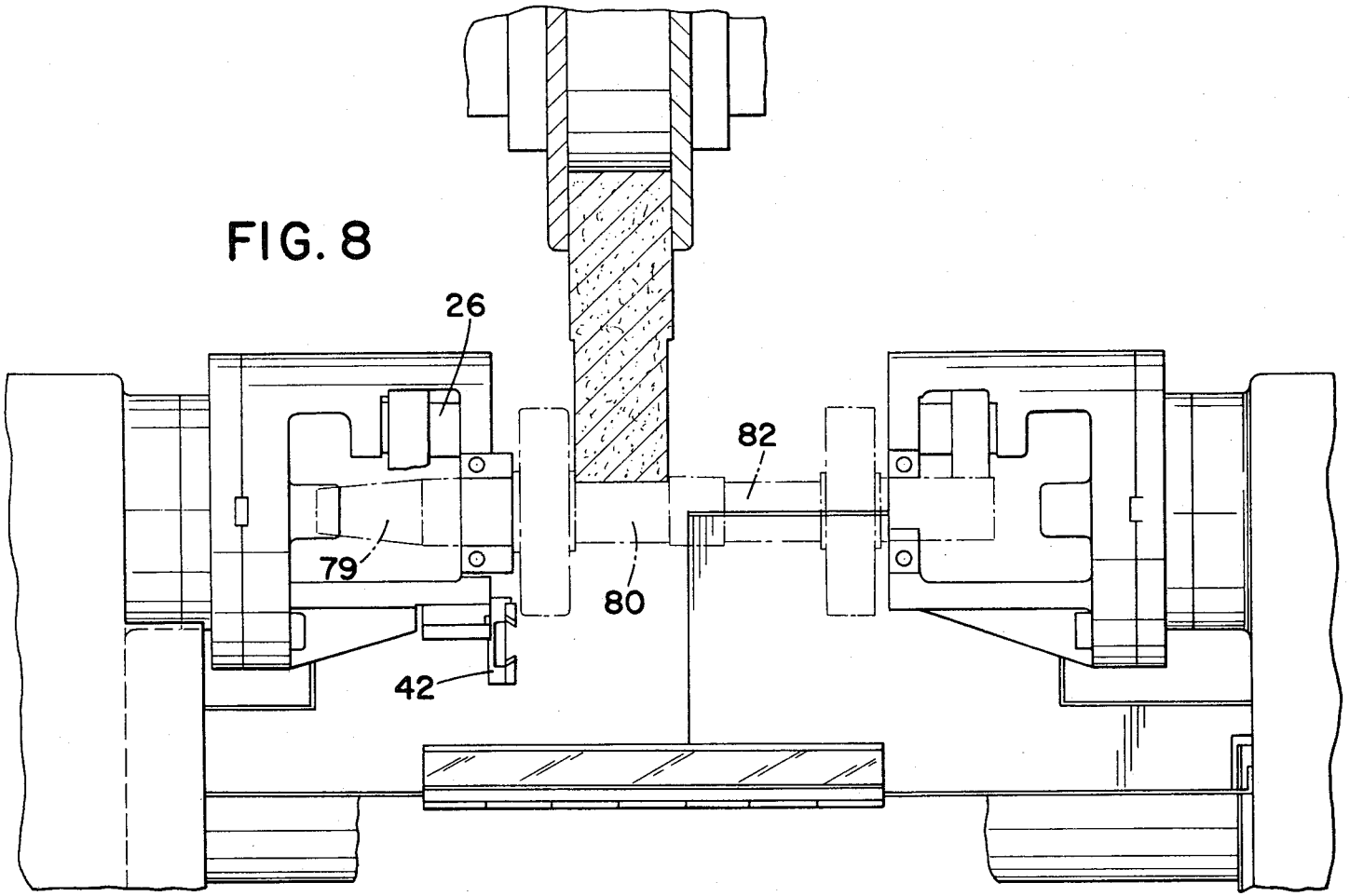
FIG. 8 is a top view of the portion of the grinding machine shown in FIG. 7.

Referring now to FIGS. 3 through 5, there is shown an adjustable vee block locator 40 for angularly locating a crankpin before grinding. Adjustable vee block locator 40 is shown supported from a bracket 42 which is attached to the body of work holder 26 on grinding machine 20. As can best be seen in FIGS. 7 through 9, workheads 26, 28 support a crankshaft 78 for rotation about one of its two crankpins.

Adjustable vee block locator 40 is formed with a main body portion 45 which supports a first vee block side member 48 and a second vee block side member 50 for rectilinear movement. Main body member 45 is connected to main body spacer and handle members 46 to form a main body assembly. An elongated adjusting member 52 extends between the positionable side members 48 and 50. Elongated adjusting member 52 has a left-handed threaded portion on one end and a right-handed threaded portion on the other end. These threaded portions engage threaded openings in adjustable side members 48 and 50.

Rotating elongated adjusting member 52 moves side members 48 and 50 simultaneously either together or apart. A knurled adjusting wheel 54 is attached to the center of elongated member 52 for rotation thereof. Knurled wheel 54 can be manually rotated in either direction to rotate elongated member 52 and move vee block side members 48 and 50 to a desired position within a selected range. A locking screw 56 is provided on main body portion 45 for engaging and locking wheel 54 in place and prevents the vee block locator from changing size. The adjustment for the proper pin bearing size and crankshaft throw can be made off or on the machine. A handle is provided on the main body assembly to facilitate manually placing the adjustable vee block locator 40 in place.

Attached to the main body assembly is a vee guide center 62 which fits into two vee guides 64 and 66 which are attached to bracket 42. Guide members 62, 64 and 66 guide the adjustable vee block locator 40 into proper position for engaging and locating a crankpin 80.

The diameter of crankpin 80 can vary over a size range and the throw of crankshaft 78 can also vary. Vee block locator 40 is adjusted to accomodate and locate any size crankpin within its range. Crankshaft 78 has a first bearing pin 80 and a second bearing pin 82. The axis defined by the end of crandshaft 78 does not extend through crankpins 80 and 82. Crankpins 80, 82 are angularly offset 180°, or another selected angle, around the longitudinal axis of crankshaft 78. During use, vee block locator 40 is attached to bracket 42 and this positions the locating surfaces of vee side portions 48 and 50 in position for locating crankpin 80. Crankpin 80 is located in the vee block locator 40 and the workholders 26, 28 of grinding machine 20 are secured to the ends of crankshaft 78 about the longitudinal axis defined by crankpin 80. The adjustable vee block locator 40 is then removed from bracket 42 to a remote storage or parking bracket 90 on grinding machine 20. A hand cam member 47 is attached to locator 40 to facilitate removal from bracket 42. Rotating hand cam member 47 slightly raises locator 40 and it can then easily be removed from bracket 42. Bearing pin 80 is then ground. After bearing pin 80 is ground it in necessary to relocate crankshaft 78 to move bearing pin 82 in position to be ground.

Workholder 26 which supports one end of crankshaft 78 is shown in FIG. 9. A bearing block 130 receives an end 79 of crankshaft 78. The end 79 of crankshaft 78 is offset from the axis of crankpin 80 around which the crankshaft 78 is to be rotated. A clamp 132 is provided for holding the end 79 of crankshaft 78 in place while grinding. Bracket 42 is attached to workholder 26.

An adjustable stud locator 100 is provided for an 180°, or other angle, relocation of crankshaft 78. Adjustable stud locator 100 includes a main body portion 102 and a plurality of threaded studs 104, 106, 108, and 110 disposed in drilled and tapped openings in main body member 102. A locking screw 113 and locknuts 115, 119, and 121 are provided for locking associated adjustable studs 104, 106, 108 or 110 in a desired position. The various adjustable studs are positioned to accomodate a range compatible with that of the adjustable vee block assembly 40. When not in use, the adjustable stud locator is stored in a parking bracket 90.

The construction of parking bracket 90 is illustrated in FIGS. 10 and 11. As can be seen in FIGS. 1 and 2, a pair of parking brackets 90 are attached to the base of crankshaft grinding machine 20. The pair of parking brackets 90 receive the adjustable vee block locator 40 and the adjustable stud locator 100 when they are not in use. A pair of guides 94, 96 are provided on bracket 90 for receiving a mating guide 62 which is attached to each locator 40 or 100. Supported on bracket 90 is a limit switch 98 which is engaged when either locator 40 or 100 is supported in bracket 90. Both locators 40 and 100 must be in place and engaging an associated limit switch 98 before grinding machine 20 can operate.

Figure 6:
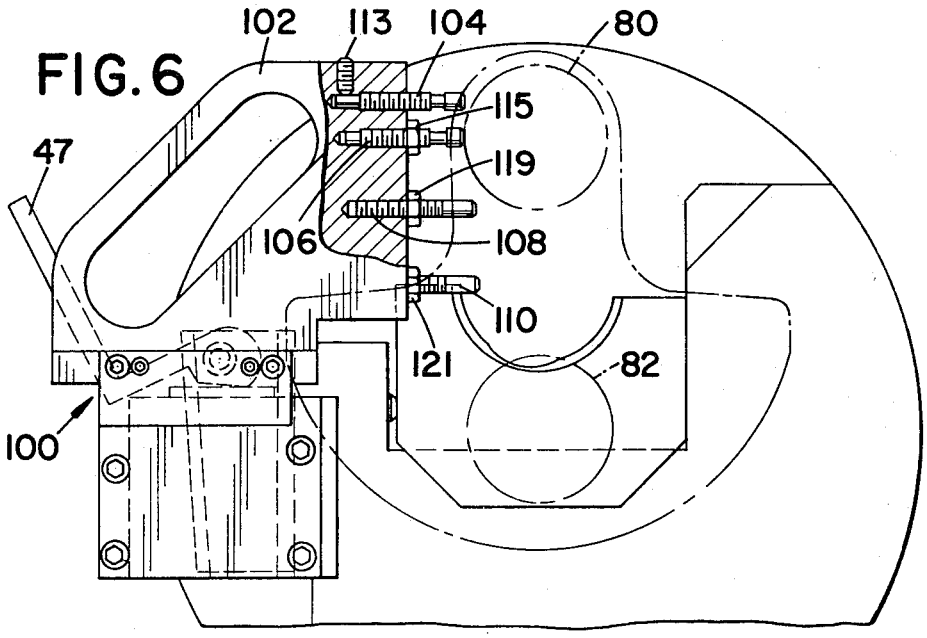
FIG. 6 is a side view of an adjustable stud crankpin locator according to the teaching of the present invention.

During use after the first crankshift pin bearing 80 is machined to size the adjustable stud locator 100 is attached to bracket 42 in the same manner as described above for adjustable vee block locator 40. After adjustable stud locator 100 is attached to bracket 42, crankshaft 78 is rotated 180°, or other angle, to bring crankpin 80 into engagement with adjustable stud 106 to locate bearing pin 82 in position for grinding. As shown in FIG. 6, when pin 80 is positioned as shown pin 82 is positioned to be rotated about its longitudinal axis. Adjustable stud locator 100 is then removed to a storage bracket 90 on grinding machine 20 and grinding of bearing pin 82 can then proceed. Locator 100 is also provided with a hand cam member 105 to facilitate removal from bracket 90. Adjustable stud locator 100 is manually adjusted by screwing the threaded studs 104, 106, 108, or 110 in or out to obtain the proper 180°, or other angle, positioning of crankshaft 78 and to maintain the proper dimensional tolerance from the first bearing surface on crankpin 80. When stud 104, 106, 108, or 110 is at the desired position it is locked in place with a locking screw 113 or locking nut 115, 119, or 121.

Interlocks are provided through limit switches 98 on the storage brackets 90 to prevent operation of grinding machine 20 until the pair of locators 40 and 100 are stored. Locators 40 and 100 cannot be left in position during grinding. The pair of adjustable locators 40, 100 provide a cost savings and reduce changeover time for a grinding machine operator.

Typical operator steps for grinding a crankshaft 78 having two crankpins 80, 82 are as follows:

1. Install angular locator 40 in the dovetail guides on bracket 42 which is attached to the body of the workholder 26.
2. Position the crankshaft 78 into workholders 26, 28.
3. Rotate crankshaft 78 until crankpin 80 is properly seated between preadjusted members 48, 50 of adjustable vee block 40.
4. Clamp crankshaft 78 in block 130 of workholders 26, 28.
5. Remove adjustable vee block locator 40 from bracket 42 and install into a parking bracket 90, actuate interlock limit switch 98.
6. Grind crankpin 80.
7. After grinding of crankpin 80 is complete, unclamp crankshaft 78.
8. Remove the adjustable stud locator 100 from parking bracket 90 and install into locating bracket 42.
9. Rotate crankshaft 78 until crankpin 80 contacts the proper preadjusted stud 106.
10. Clamp crankshaft 78 in blocks 130 of workholders 26, 28.

11. Remove the adjustable stud locator 100 from locating bracket 42 and install in its associated parking bracket 90, actuating interlock limit switch 98.

12. Grind crankpin 82.

This procedure locates crankpin 80 from the initially turned surface and locates crankpin 82 at an angle of 180°, or other selected angle, from the ground surface on crankpin 80.

What is claimed is:

1. An adjustable vee block assembly for angular locating the crankpin of a crankshaft which is supported in a grinding machine comprising:

a main body portion;

a first vee side member, having a threaded opening formed therein, supported on said main body portion for rectilinear movement;

a second vee side member, having a threaded opening formed therein and spaced apart from said first side member, supported on said main body portion for rectilinear movement;

an elongated rotatable position adjusting member having a left-hand thread on one end and a right-hand thread on the other end disposed between and engaging the threaded openings in said first vee side member and said second vee side member for relative positioning thereof;

a locking member for engaging and locking said elongated rotatable position adjusting member against rotation for maintaining said first vee side member and said second vee side member at a selected position; and a support bracket, securely attached to the grinding machine, for receiving a portion of said main body portion and supporting the locked first and second vee blocks in position for angular locating a crankpin on the crankshaft.

2. An adjustable locator for angular locating the crankpin of a crankshaft which is supported in a grinding machine comprising:

a main body member;

a handle formed on said main body member to facilitate handling of said locator;

a plurality of adjustable studs, vertically spaced apart and project from said main body member, for locating crankpins on various size crankshafts;

stud locking means associated with each adjustable stud for locking it in a desired position to acurately angularly locate a crankpin; and, a support bracket, securely attached to the grinding machine, for receiving a portion of said main body member to support one of the locked studs in position for angular locating a crankpin on the crankshaft.

3. An adjustable locator as claimed in claim 2 comprising:

a cam lifting member attached to said main body member and being rotatable to raise said main body member from said support bracket.

* * * * *